US010294619B1

(12) United States Patent
Pallack

(10) Patent No.: US 10,294,619 B1
(45) Date of Patent: May 21, 2019

(54) GRASS COMB AND FECES REMOVAL APPARATUS

(71) Applicant: Ronald D. Pallack, Elk Grove Village, IL (US)

(72) Inventor: Ronald D. Pallack, Elk Grove Village, IL (US)

( * ) Notice: Subject to any disclaimer, the term of this patent is extended or adjusted under 35 U.S.C. 154(b) by 0 days.

(21) Appl. No.: 16/017,550

(22) Filed: Jun. 25, 2018

(51) Int. Cl.
*E01H 1/00* (2006.01)
*E01H 1/12* (2006.01)
*B08B 1/00* (2006.01)
*B08B 13/00* (2006.01)

(52) U.S. Cl.
CPC ..... *E01H 1/006* (2013.01); *B08B 1/005* (2013.01); *B08B 13/00* (2013.01)

(58) Field of Classification Search
CPC ..... E01H 1/006; E01H 1/005
USPC ..... 294/1.3, 1.4; 37/434; 15/79.2, 82, 104.8, 15/257.1; 56/198, 33, 400.02, 400.08, 56/400.13, 330
See application file for complete search history.

(56) References Cited

U.S. PATENT DOCUMENTS 425,695 A * 4/1890 Pontious
647,396 A * 4/1900 Furnas
1,224,349 A * 5/1917 Yessne ..... E01H 1/056 15/79.1
1,471,929 A * 10/1923 Todd ..... A01G 20/43 56/400.13
2,544,505 A * 3/1951 Semen ..... B62B 1/24 280/47.31
3,591,883 A * 7/1971 Armstrong ..... E01H 1/047 15/149
3,781,940 A * 1/1974 Lehrer ..... A47L 11/22 15/104.8
4,130,953 A * 12/1978 Bruno ..... E01H 5/02 280/47.26
4,302,894 A * 12/1981 Emma ..... B62B 1/147 298/2
4,765,666 A * 8/1988 Parks ..... E01H 1/006 15/79.2
5,048,206 A * 9/1991 Jones ..... B62B 1/147 280/651
6,113,166 A * 9/2000 Wynn ..... E01H 1/1206 15/104.8
6,260,895 B1 * 7/2001 Nichols ..... E01H 1/1206 15/104.8

* cited by examiner

*Primary Examiner* — Paul T Chin
(74) *Attorney, Agent, or Firm* — Charles F. Meroni, Jr.; Meroni & Meroni, PC

(57) ABSTRACT

A grass comb for feces removal made up of a body, a control panel connected to the body, the panel having a first lever and a second lever, a grate, the grate connected to the first lever and the body, the grate having a raised position and a lowered position, and the state of the grate responding to a user input on the first lever, a scraper connected to the body and operably connected to the second lever, wherein the scraper is oriented such that it can move from a first position to a second position according to user input on the second lever, wherein when the grate is in the raised position, moving the scraper from the first position to the second position pushes feces off the grate and into a bag.

18 Claims, 5 Drawing Sheets

GRASS COMB AND FECES REMOVAL APPARATUS

FIELD OF THE INVENTION

The present invention generally relates to lawn devices, particularly those designed for picking up feces.

BACKGROUND

Fast and trouble-free removal of pet waste from various surfaces lawns is a traditional and confounding problem for owners of dogs, horses, and many other large pets. For many years, since pets have been confined to fenced yards or large outside penned areas, pet owners have had the need for a tool to aid in keeping these areas clean and sanitary, by removing pet waste from moderate to deep grass and other outside surfaces on a regular basis. Often times pet owners will resort to picking up the waste by hand, or hiring expensive outside services to do so. Numerous devices have been conceived with the goal of removing pet waste from yards, large pens and other surfaces, however most of those have either not been effective, were poorly constructed, difficult to use or never proved to be successful in reaching the marketplace.

Despite the various attempts to provide pet owners with solutions, the tools and devices marketed today fall short in solving most of the problems that pet owners are looking to remedy. Problems like; constant bending over to collect the feces, having a tool with two parts requiring both hands to remove the deposits, having to empty the tool with each pickup, or the device can't get through long or thick grass to remove the feces. Other tools are constructed with very poor or weak materials, or have spring loaded or other moving parts, which tend to break and render the tool useless. Such devices include those listed below.

US PGPUB No. 2012/0080894 by Williamson discloses The Doggie Scoop, included with a disposable plastic bag, is a device for the efficient and sanitary collection and disposal of canine fecal matter (dog poop). Before using the Doggie Scoop, insert a disposable plastic bag into Scoop, then, when a dog gets ready to poop, slide the lock on the handle of the Scoop forward with your thumb to open the Scoop (which will be opened horizontally), then slide the extension of the Scoop under the dog to catch the poop. The extension of the Scoop should lie flat against the ground since dogs usually squat close to the ground when they poop. The wheels on the Doggie Scoop help in sliding the Scoop under the dog, and since the wheels can rotate 360 degrees, the Scoop can be moved in any direction to accommodate any movement of the dog. When the dog is finished, slide the Scoop out from under the dog, squeeze the handle on the Scoop to close the Scoop, and with your thumb, slide the lock on the handle of the Scoop backward to lock the Scoop and keep it closed. The poop that collects on the extension will now drop into the storage box. Grasp the pull cords on the enclosed plastic bag to remove the bag with its contents, then dispose of the plastic bag in a garbage can. The Doggie Scoop enables a person to collect the dog poop before it touches the ground and to dispose of the poop in a sanitary manner without having to bend down to pick up the poop or to touch the stuff.

U.S. Pat. No. 9,332,732 by Stoccardo discloses a hands-free method for handling animal waste entails securing a support structure to an animal, preferably a dog. The support structure includes a first latching mechanism which is used to secure a disposable waste receptacle. The disposable waste receptacle is handled via a manipulating tool and corresponding second latching mechanism, with the manipulating tool being operated by means of a user interface. The manipulating tool is used to couple the disposable waste receptacle to the first latching mechanism. After the disposable waste receptacle accumulates excrement, the manipulating tool is used to decouple the disposable waste receptacle from the support structure and discard the disposable waste receptacle in a separate trash receptacle.

U.S. Pat. No. 9,693,533 by Taylor et al, discloses a scooping pan having a rear dumping feature that can be configured to scoop up general refuse, pet refuse, urine clumps, etc. from the ground, a litter box, etc. The scooping pan can optionally include one or more openings or slots that enable litter to pass through the openings or slots when the pet refuse, urine clumps, etc. are removed from the litter box. The rear of the scooping pan includes an openable flap that enables the general refuse, pet refuse, urine clumps, etc. in the scooping pan to be dumped out of the rear of the scooping pan.

U.S. Pat. No. 9,850,632, by Hays discloses, a tool for removing and holding dog excrement from both grass, and other non-grass surfaces, comprised of a pole handle at the upper portion and a set of beveled tines and collection pan on the lower end. The handle is connected at the rear of the collection pan at a an angle which aids in placement of the fork in the best possible position for leverage and moving smoothly beneath the feces. The separated beveled tines allow easy penetration of grass or debris beneath the feces, which is moved over the beveled tines and into the collection pan with a slight tip of the fork. The collection pan is formed with raised front, back and sidewalls, which recess the collection pan to hold the gathered feces. The collection pan is capable of containing considerable feces prior to being emptied into an appropriate trash receptacle.

In addition, many other devices merely make feces pickup more sanitary, rather than increasing the speed at which such tasks & chores can be carried out. Therefore, there is a significant need for a device that solves the problems of both speed and sanitation.

These problems, and others, have been addressed by the grass comb disclosed herein and discussed in greater detail below.

BRIEF SUMMARY

Currently-available devices, as discussed above, therefore lack the features for quickly, safely, and durably picking up pet feces in grass over a large area of ground. Therefore, the current disclosure contemplates a Grass Comb designed for pickup up and storing feces.

The Grass Comb according to the present disclosure, consists of a few basic components: 1) a control panel; 2) a comb; 3) a box assembly with wheels; 4) a bag for storing feces; and 5) a blade for pushing feces from the comb into the bag. Other, more detailed descriptions follow herein.

In function, the Grass Comb is pushed through a yard of field that contains feces. Feces accumulate on the comb, and then through use of the control panel and/or levers, the blade then pushes accumulated feces into the bag where they are stored until the bag is full, or the job is completed and the bag is then disposed.

The advantages of such an application become clear when one is experienced in removing feces from a yard or other large areas. Typical devices currently on the market do not have the confluence and plethora of features contemplated and described herein.

In a first embodiment the disclosure contemplates an apparatus for removing animal feces made of a body, a handle attached to the body, a control panel connected to the handle, the panel having a first lever, wheels connected to the body and raising the body, a grate, the grate connected to the first lever and the body, the grate having a raised position and a lowered position, and the state of the grate responding to a user input on the first lever, and a bag, the bag having an opening and contained within the body and oriented such that when the grate is in the raised position, the opening is aligned with the grate such that animal feces can enter the bag. In some embodiments it contemplates a second lever located on the control panel, a scraper connected to the body and operably connected to the second lever; wherein the scraper is oriented such that it can move from a first position to a second position according to user input on the second lever, wherein when the grate is in the raised position, moving the scraper from the first position to the second position pushes feces off the grate and into the bag; the first and second levers can be locked into a chosen position and maintained in that position using springs; the first lever is connected to the grate by a cord, and the second lever is connected to the scraper by a cord; a first end of the grate is connected to the body such that it pivots around an axis, and the cord connecting the first lever and the grate passes through three pulley wheels such that the mechanical force of the cord on the grate operates on a second end of the grate pivoting the grate on the axis; the grate has a plurality of forward facing fingers; said forward facing fingers being tapered to facilitate feces moving onto the grate; the scraper further comprises a paddle; illuminating lights on the control panel, said lights powered by a battery contained within the control panel and being activated by a toggle on the control panel; forward facing illuminating lights positioned on the body of the apparatus said lights powered by a battery contained within the control panel and being activated by a toggle on the control panel; an electric motor contained within the body and connected to the wheels and the control panel, said motor powered by a battery contained within the body of the apparatus and being activated by a toggle on the control panel; wherein the device 28 inches wide from one side of the body to another.

In another embodiment the disclosure contemplates A grass comb for feces removal made up of a body, a control panel connected to the body, the panel having a first lever and a second lever, a grate, the grate connected to the first lever and the body, the grate having a raised position and a lowered position, and the state of the grate responding to a user input on the first lever, a scraper connected to the body and operably connected to the second lever, wherein the scraper is oriented such that it can move from a first position to a second position according to user input on the second lever, wherein when the grate is in the raised position, moving the scraper from the first position to the second position pushes feces off the grate and into a bag. In some embodiments the grate has a plurality of forward facing fingers, said forward facing fingers being tapered to facilitate feces moving onto the grate; a backend of the grate is connected to the body such that it pivots around an axis, and the first lever is connected to the grate by a cord that passes through two pulley wheels and a guide such that the mechanical force of the cord on the grate operates on a front end of the grate pivoting the grate on the axis; the first and second levers can be locked into a chosen position and maintained in that position using springs.

In some embodiments the disclosure contemplates a method for picking up feces from a grass field comprising: providing an apparatus composed of a body, a handle attached to the body, a control panel connected to the handle, the panel having a first lever, wheels connected to the body and raising the body, a grate, the grate connected to the first lever and the body, the grate having a raised position and a lowered position, and the state of the grate responding to a user input on the first lever, a bag, the bag having an opening and contained within the body and oriented such that when the grate is in the raised position, the opening is aligned with the grate such that animal feces can enter the bag; a second lever located on the control panel, a scraper connected to the body and operably connected to the second lever, wherein the scraper is oriented such that it can move from a first position to a second position according to user input on the second lever, wherein when the grate is in the raised position, moving the scraper from the first position to the second position pushes feces off the grate and into the bag, positioning the grate in the lowered position, pushing the apparatus towards feces located on the grass field, causing said feces to move onto said grate, actuating the first lever to move the grate to the raised position, actuating the second lever to move the scraper and cause the feces to move into the bag. In some cases the grate comprises: a plurality of forward facing fingers; said forward facing fingers being tapered to facilitate feces moving onto the grate; returning the scraper to the first position, and returning the grate lever to the lowered position. Such embodiments do not represent the full scope of the invention.

Reference is made therefore to the claims herein for interpreting the full scope of the invention. Other objects of the present invention, as well as particular features, elements, and advantages thereof, will be elucidated or become apparent from, the following description and the accompanying drawing figures.

DESCRIPTION OF THE DRAWINGS

The present invention may be better understood, and its numerous objects, features, and advantages made apparent to those skilled in the art by referencing the accompanying drawings.

DETAILED DESCRIPTION

Referring now the drawings with more specificity, the present invention essentially provides for a grass comb and feces pickup device. The preferred embodiments of the present invention will now be described with reference to FIGS. 1-5 of the drawings. Variations and embodiments contained herein will become apparent in light of the following descriptions.

Figure 1:
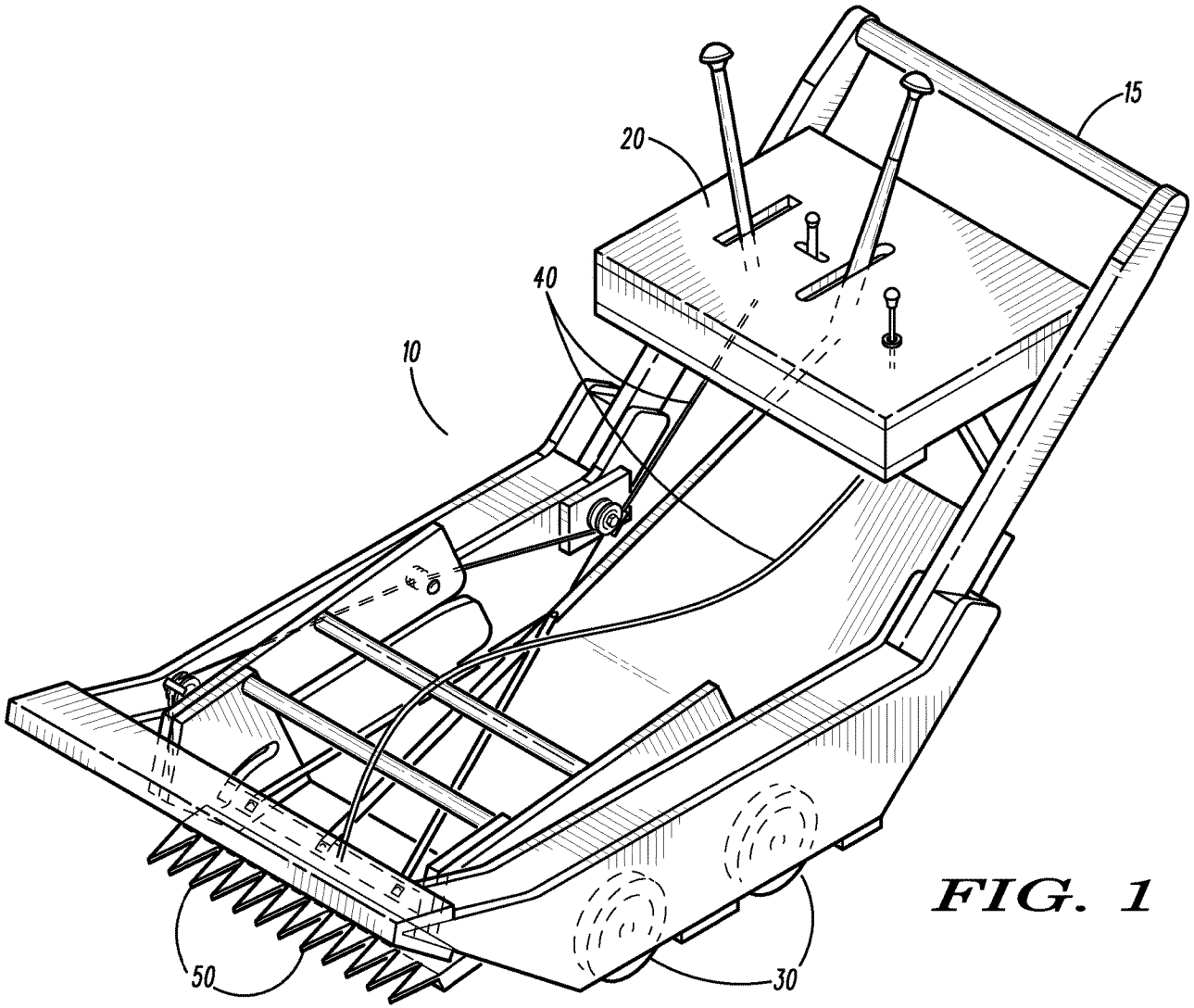
FIG. 1 is a perspective view of a grass comb according to the present disclosure.

Looking now to FIG. 1 a perspective view of the grass comb 10 is shown. Grass comb 10 is pushed by a user at handle 15, and various controls are available at panel 20. Typically, comb 10 will utilize wheels 30, control wires 40, and a grate 50. The grate 50 is typically oriented forward at a front end of the grass comb 10.

Figure 2:
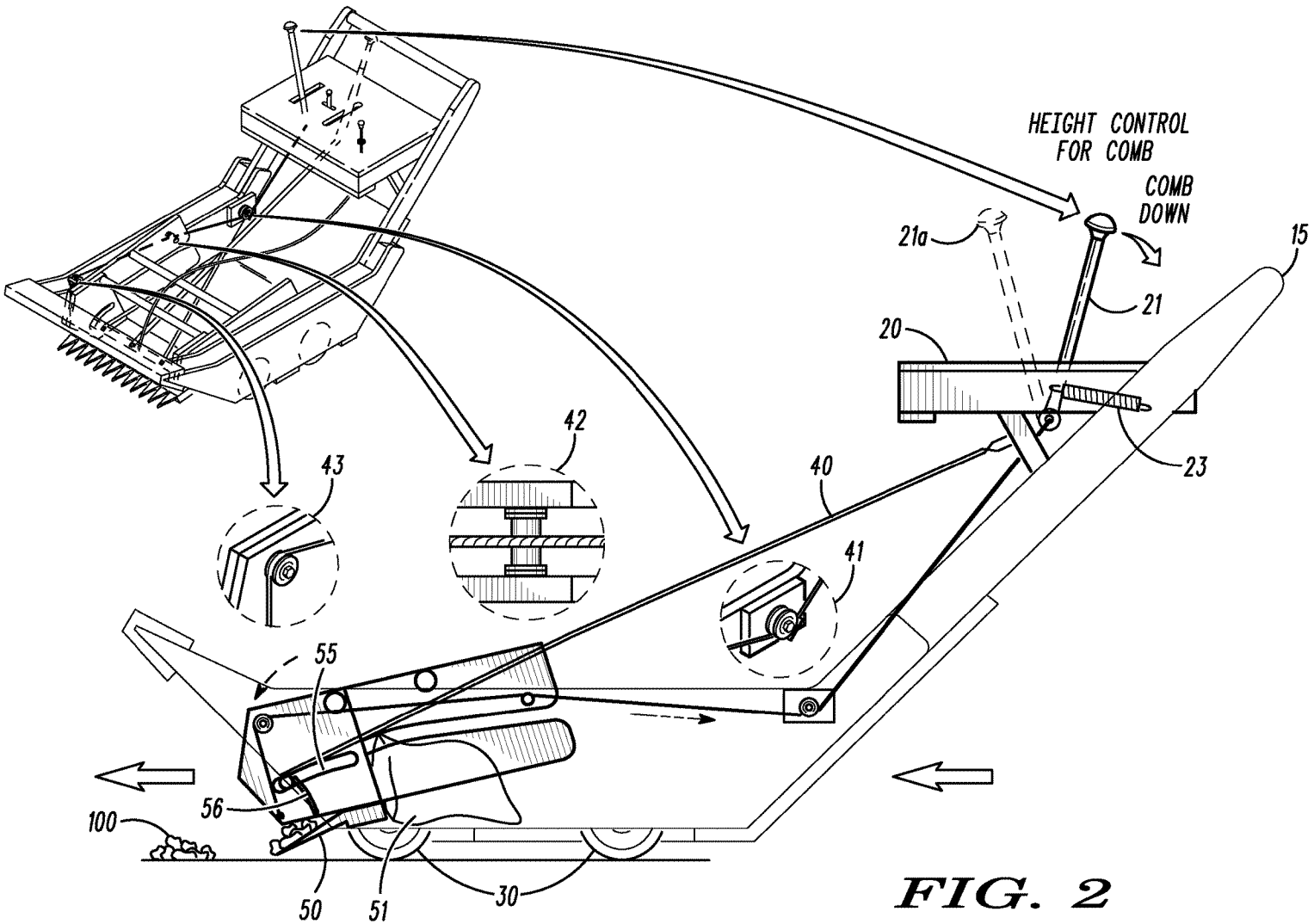
FIG. 2 is a sectional view of the grass comb according to the present disclosure.

FIG. 2 shows a detailed, sectional, of grass comb 10. In this view it is shown that control panel 20 includes lever 21 which is responsible for controlling grate 50. Lever 21 can be placed into operational state 21*a* which will raise the grate 50 which aids in the transport of feces 100 into bag 51. Control wires 40 can be passed through pulley wheels 41, and/or 43 and guide 42. Wires 40 can also control the scraper 55 which is selectively used in pushing feces 100 into bag 51. Scraper connector 56 also can be used for transporting feces 100.

Figure 3:
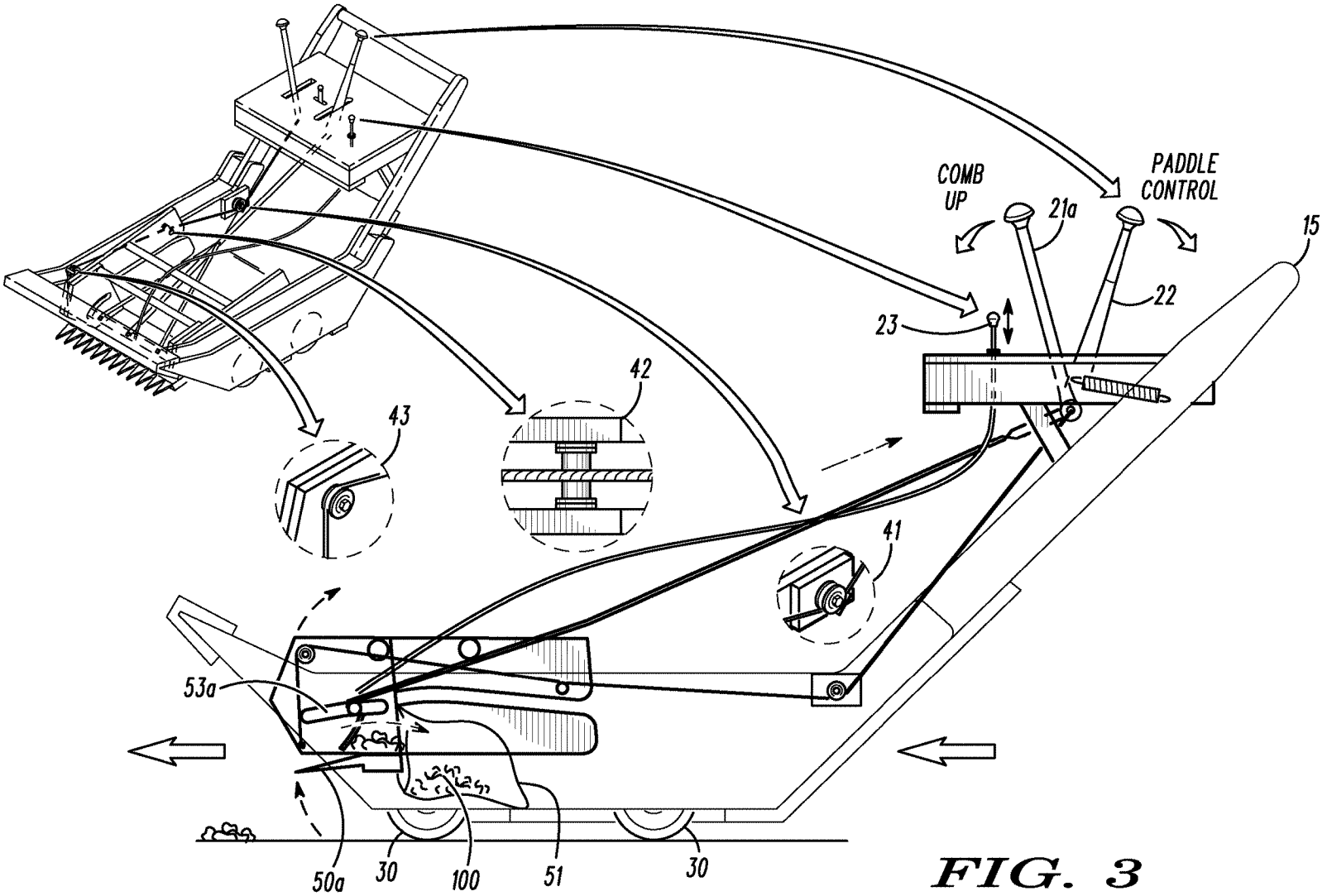
FIG. 3 is second sectional view of the grass comb according to the present disclosure in a second state.

Looking to FIG. 3. shows a detailed, sectional, of grass comb 10 an a second state. In this state Paddle control 22 is also shown, as is control 23. In this state, the grate 50 is raised in state 50*a* and scraper 55 is in state 55*a* which is when the paddle 55 is pushing feces 100 into bag 51. This means that it difference from FIG. 2 in configuration, but demonstrates the operation of same or similar devices.

Figure 4:
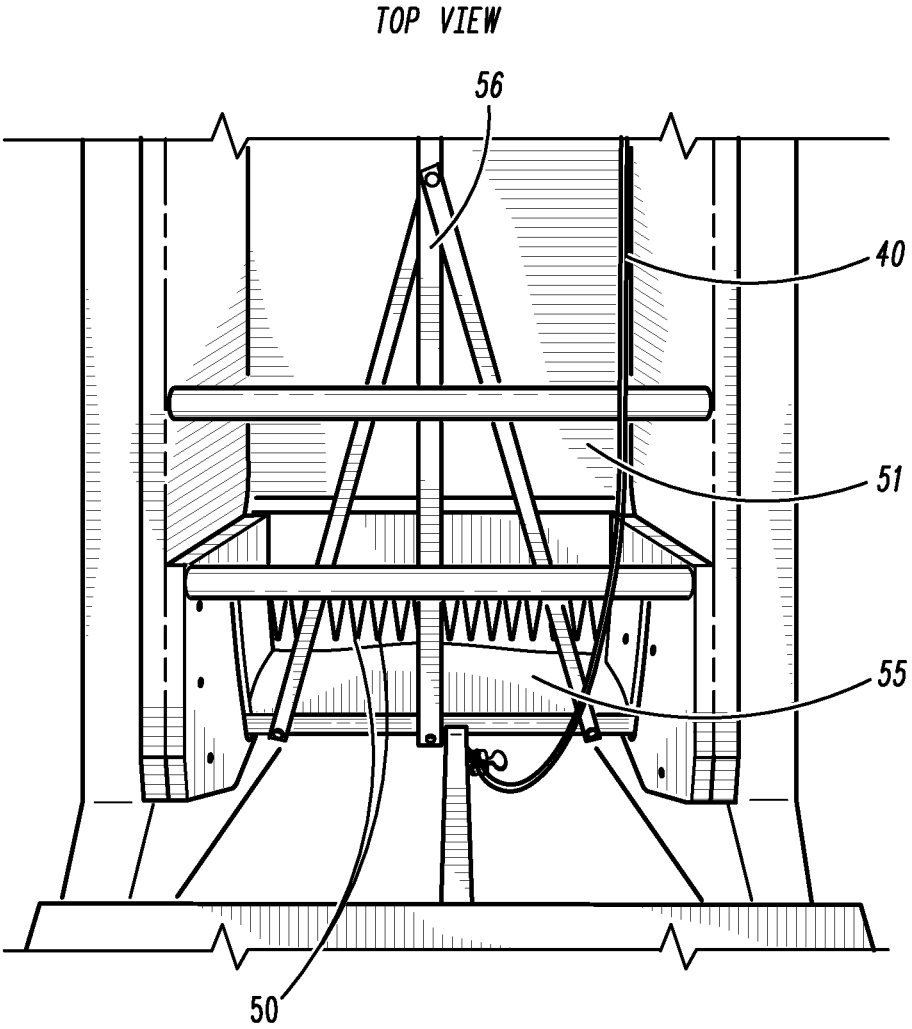
FIG. 4 is a top view of a portion of the grass comb according to the present disclosure.

FIG. 4 displays a top view, close up, view of the grass comb 10. This view more closely shows the operation of grate 50, bag 51, scraper 55, and connector 56. In this view it can be seen that connector 56 stabilizes the scraper that is used for moving feces 100.

Figure 5:
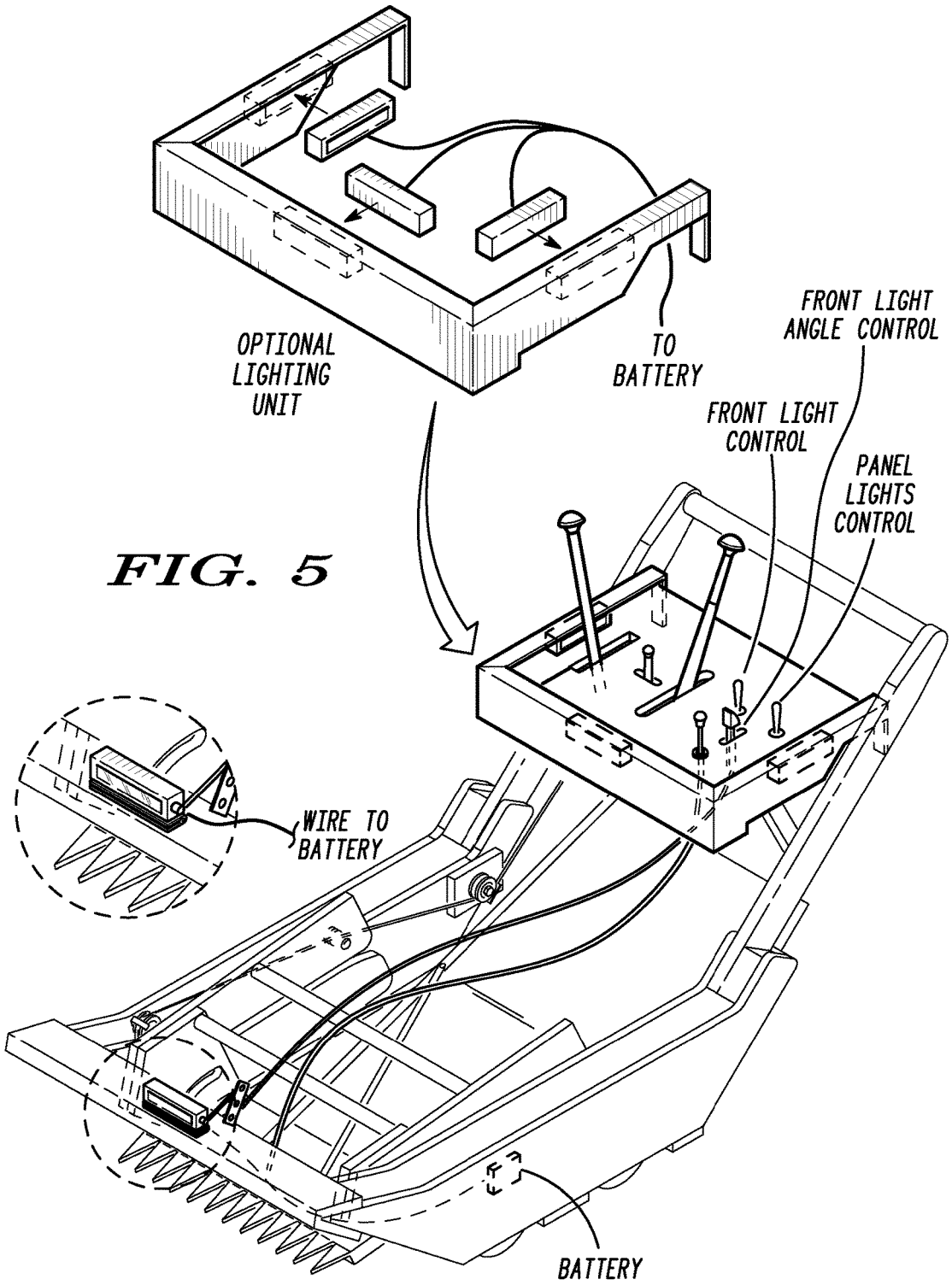
FIG. 5 is a semi-exploded perspective view including an optional lighted control panel.

Looking to FIG. 5 we can now see an embodiment of grass comb 10 which demonstrates an optional battery and lighting unit for the control panel 20. In this embodiment it is clearly shown that both panel 20, and grass comb 10 can be illuminated using light controls placed on the control panel. Batteries can be placed within the control panel, or on the side of the device as a whole. In addition, such a control panel 20 can be configured for use with an electric or gas motor for driving the device.

INDUSTRIAL APPLICABILITY AND CONSTRUCTION

In some instances the grass comb 10 according to the present disclosure is constructed to specifications to deal with the issues associated with a lawn care device. To that end construction of comb 10 preferably is constructed from durable and sanitary materials. In one embodiment the device is made from aluminum, and in a second it is constructed from plastic. While construction from wood and steel is also possible, heavy materials are disfavored in implementations that do not include a motor for driving the grass comb 10. It may be preferable for cables 40 and the other moving parts to be made from steel or otherwise more durable materials as they will encounter more wear and tear than the body of the grass comb 10.

The dimension of the grass comb in one embodiment is from the handle is 59 inches long and 28 inches wide from fender to fender. Body of grass comb 10 is held up by the wheels it is off the ground. In some embodiments the wheels are 10" ball bearing wheels. The blade 55 can be made from a rod, typically it is a ⅝" in thickness rod. On both ends there can be a ½" steel ball for rotation.

As can be seen in the Figures, grate 50 can be shaped to be in a forward facing comb configuration, and the comb fingers can be tapered to improve performance.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. An apparatus for removing animal feces comprising:
a body;
a handle attached to the body;
a control panel connected to the handle, the panel having a first lever;
wheels connected to the body and raising the body;
a grate, the grate connected to the first lever and the body, the grate having a raised portion and a lowered position, and the state of the grate responding to a user input on the first lever;
a bag, the bag having an opening and contained within the body and oriented such that when the grate is in the raised position, the opening is aligned with the grate such that animal feces can enter the bag;
a second lever located on the control panel;
a scraper connected to the body and operably connected to the second lever; wherein
the scraper is oriented such that it can move from a first position to a second position according to user input on the second lever, wherein when the grate is in the raised position, moving the scraper from the first position to the second position pushes feces off the grate and into the bag.

2. The apparatus of claim 1 further comprising:
forward facing illuminating lights positioned on the body of the apparatus.

3. The apparatus of claim 1 wherein:
the first and second levers can be locked into a chosen position and maintained in that position using springs.

4. The apparatus of claim 1 wherein:
the first lever is connected to the grate by a cord; and
the second lever is connected to the scraper by a cord.

5. The apparatus of claim 4 wherein:
a first end of the grate is connected to the body such that it pivots around an axis; and
the cord connecting the first lever and the grate passes through three pulley wheels such that the mechanical force of the cord on the grate operates on a second end of the grate pivoting the grate on the axis.

6. The apparatus of claim 5, the end caps comprising:
the scraper further comprises a paddle.

7. The apparatus of claim 1 wherein:
the grate has a plurality of forward facing fingers; said forward facing fingers being tapered to facilitate feces moving onto the grate.

8. The apparatus of claim 1, further comprising:
illuminating lights on the control panel, said lights powered by a battery contained within the control panel and being activated by a toggle on the control panel.

9. The apparatus of claim 8 further comprising:
forward facing illuminating lights positioned on the body of the apparatus said lights powered by a battery contained within the control panel and being activated by a toggle on the control panel.

10. The apparatus of claim 8 further comprising:
an electric motor contained within the body and connected to the wheels and the control panel;
said motor powered by a battery contained within the body of the apparatus and being activated by a toggle on the control panel.

11. The apparatus of claim 1 wherein the device 28 inches wide from one side of the body to another.

12. A grass comb for feces removal comprising:
a body;
a control panel connected to the body, the panel having a first lever and a second lever;

a grate, the grate connected to the first lever and the body, the grate having a raised portion and a lowered position, and the state of the grate responding to a user input on the first lever;

a scraper connected to the body and operably connected to the second lever, wherein the scraper is oriented such that it can move from a first position to a second position according to user input on the second lever, wherein when the grate is in the raised position, moving the scraper from the first position to the second position pushes feces off the grate and into a bag.

13. The grass comb of claim 12 wherein:

the grate has a plurality of forward facing fingers; said forward facing fingers being tapered to facilitate feces moving onto the grate.

14. The grass comb of claim 13 wherein:

a backend of the grate is connected to the body such that it pivots around an axis; and the first lever is connected to the grate by a cord that passes through three pulley wheels such that the mechanical force of the cord on the grate operates on a front end of the grate pivoting the grate on the axis.

15. The grass comb of claim 12 wherein:

the first and second levers can be locked into a chosen position and maintained in that position using springs.

16. An method for picking up feces from a grass field comprising:

providing an apparatus composed of a body, a handle attached to the body, a control panel connected to the handle, the panel having a first lever, wheels connected to the body and raising the body, a grate, the grate connected to the first lever and the body, the grate having a raised position and a lowered position, and the state of the grate responding to a user input on the first lever, a bag, the bag having an opening and contained within the body and oriented such that when the grate is in the raised position, the opening is aligned with the grate such that animal feces can enter the bag; a second lever located on the control panel, a scraper connected to the body and operably connected to the second lever, wherein the scraper is oriented such that it can move from a first position to a second position according to user input on the second lever, wherein when the grate is in the raised position, moving the scraper from the first position to the second position pushes feces off the grate and into the bag;

positioning the grate in the lowered position;

pushing the apparatus towards feces located on the grass field, causing said feces to move onto said grate;

actuating the first lever to move the grate to the raised position;

actuating the second lever to move the scraper and cause the feces to move into the bag.

17. The method of claim 16 wherein the grate comprises:

a plurality of forward facing fingers; said forward facing fingers being tapered to facilitate feces moving onto the grate.

18. The apparatus of claim 17 further comprising:

returning the scraper to the first position; and returning the grate lever to the lowered position.

* * * * *